US005972162A

United States Patent [19]

Cesna

[11] Patent Number: 5,972,162

[45] Date of Patent: Oct. 26, 1999

[54] WAFER POLISHING WITH IMPROVED END POINT DETECTION

[75] Inventor: Joseph V. Cesna, Niles, Ill.

[73] Assignee: Speedfam Corporation, Chandler, Ariz.

[21] Appl. No.: 09/003,346

[22] Filed: Jan. 6, 1998

[51] Int. Cl.[6] ..... B24B 49/04

[52] U.S. Cl. ..... 156/345; 451/6; 451/41

[58] Field of Search ..... 156/345; 216/88; 438/5; 451/5, 6, 41, 287

[56] References Cited

U.S. PATENT DOCUMENTS

| | | | |
|---|---|---|---|
| Re. 34,425 | 11/1993 | Schultz | 51/165.74 |
| 4,211,041 | 7/1980 | Sakulevich et al. | 51/131.3 |
| 4,272,924 | 6/1981 | Masuko et al. | 51/165 |
| 4,680,893 | 7/1987 | Cronkhite et al. | 51/5 |
| 4,793,895 | 12/1988 | Kaanta et al. | 438/17 |
| 5,081,796 | 1/1992 | Schultz | 51/165.74 |
| 5,224,304 | 7/1993 | Cesna | 51/281 |
| 5,245,794 | 9/1993 | Salugsugan | 51/165 |
| 5,265,378 | 11/1993 | Rostoker | 51/165 |
| 5,329,732 | 7/1994 | Karlsrud et al. | 51/131 |
| 5,486,701 | 1/1996 | Norton et al. | 250/372 |
| 5,492,594 | 2/1996 | Burke et al. | 216/86 |
| 5,543,919 | 8/1996 | Mumola | 356/382 |
| 5,555,472 | 9/1996 | Clapis et al. | 356/357 |
| 5,562,529 | 10/1996 | Kishii et al. | 451/36 |
| 5,563,709 | 10/1996 | Poultney | 356/371 |
| 5,624,300 | 4/1997 | Kishii et al. | 451/36 |
| 5,733,171 | 3/1998 | Allen et al. | 451/5 |

FOREIGN PATENT DOCUMENTS 59-227361
(A) 12/1984 Japan .

*Primary Examiner*—Robert Kunemund
*Assistant Examiner*—Shamim Ahmed
*Attorney, Agent, or Firm*—Fitch, Even, Tabin & Flannery

[57] ABSTRACT

A probe assembly is provided for semiconductor wafer polishing and similar wafer treatments. The polishing table forms a recess for receiving the probe, with the probe free end located to view interior portions of a semiconductor wafer temporarily passing over the recess. Probe data may conveniently be used for polishing end point determination.

18 Claims, 6 Drawing Sheets

WAFER POLISHING WITH IMPROVED END POINT DETECTION

BACKGROUND OF THE INVENTION

1. Field of the Invention

The present invention pertains to the polishing of wafers, and more particularly to the accurate polishing of wafers of semiconductor material, suitable for use in a semiconductor processing clean room environment.

2. Description of Related Art

The production of semiconductor devices, such as integrated circuits, begins with the preparation of high quality semiconductor wafers. Due to the purity of the material required, unprocessed semiconductor "blanks" have a substantial cost and, because of their relatively thin wafer construction and relatively fragile material composition, are susceptible to breaking caused by over-bending and chipping caused by inadvertent contact with the wafer edge. With the development of each layer on a semiconductor surface, the cost of the semiconductor wafer is substantially increased. During integrated circuit production as circuit layers are built up on the blank, an extremely flat surface is desired on at least one face of the wafer. Flatness is attained by polishing, which generally includes supporting the back side of the wafer with a wafer carrier or chuck, carried by an arm or other apparatus for pressing the front face of the wafer against a polishing surface. The polishing process typically employs one or more chemical actions as well as an abrasive, mechanical action. Accordingly, this general type of wafer production has come to be referred to as Chemical Mechanical Polishing (CMP).

Typically, the polishing surface is carried on a rigid flat table which is rotated to provide movement for the mechanical abrasion. The polishing surface is typically flooded with a special purpose material (referred to as a slurry) having the chemical and mechanical abrasion properties needed for the desired operation.

With the increasing power of electronic devices, the density of active electronic circuit components developed on a given surface area of a wafer is continually being increased. The layers of electronic circuitry developed on the face of the semiconductor wafer are typically constructed using photolithography or other techniques. In order to increase the resolution of the photo patterns which can be "printed"on the semiconductor wafer surface, the semiconductor wafer surface must be extremely flat, both in a so-called "local" sense as well as in a "global" sense. That is, typically the surface of the semiconductor wafer is divided into many local portions, each containing identical copies of the desired semiconductor device. The portion of the semiconductor's surface for any single semiconductor device is relatively small, but still must be extremely flat and free of surface irregularities, within extremely tight tolerances, oftentimes measured on a microscopic scale. Current commercial production techniques further require that the wafer front surface have a global (or edge-to-edge) planarity to facilitate batch processing of the entire usable portion of the wafer surface in a single operation. In the interest of economical manufacture, more complete utilization of the wafer surface is continually being sought, so that a larger number of electronic devices can be obtained from a single wafer, on a routine basis.

Typically, semiconductor wafers are polished many times during the course of semiconductor device fabrication. As multiple layers of conductors and dielectrics are built up on the surface of a wafer, polishing is usually required after the deposition of each layer to restore any deviation from highly demanding local and global flatness tolerances. Because so-called "out-of-flatness" tolerances must be related to the total, finished construction, it is critical that the polishing process be held to extremely close tolerances such that finished densely packed structures do not interfere with one another.

It is important, during the course of preparing the semiconductor surface, that proper amounts of polishing are applied to assure that the desired degree of flatness is attained without undesirable intrusion into the deposited layers, which might compromise their intended electronic operation. While it is possible to periodically remove the wafer being processed from the polishing apparatus in order to inspect the wafer surface, such practices are undesirable in that they subject the wafer to additional handling with an attendant risk of injury. Further, the environmental condition of the wafer must be taken into account. For example, wafers being processed are oftentimes maintained immersed in an aqueous environment. In order to facilitate remote inspection of the wafer, the wafer would have to be removed from the aqueous environment, cleaned, and dried to facilitate inspection. Care must be taken to guard against distortion of the wafer, and the introduction of wet/dry cycles may give rise to unwanted distortion and may introduce harmful contamination.

In order to overcome these drawbacks, attention has been directed to so-called in-situ end point detection. A variety of techniques have been developed over the years. For example, various electrical signals have been passed through the wafer and the area of polishing activity, with the electrical signal thereby being modified in a certain manner, dependent upon the amount of polishing of the wafer surface. In general, such techniques rely upon an indirect detection of the wafer surface characteristics. Correlation of various modifications of the electrical signal to the wafer surface characteristics typically requires considerable experience and intense research for each particular process being carried out. Changes in polishing conditions (for example changes in slurry composition, abrasive structures, polish wheel compositions and the like) oftentimes require additional study with new correlation techniques being developed in order to indirectly indicate the surface condition of the wafer being processed in an accurate manner.

The outer edges of semiconductor wafers have been monitored on a real-time basis. Wafers mounted on reciprocating arms are carried to the edge of a polishing table, and slightly beyond by the reciprocating action. Thus, for a brief instant with each cycle of reciprocation, the bottom surface of the wafer is exposed to a monitoring probe located immediately adjacent the edge of the polishing wheel. However, only a relatively minor outer portion of the wafer can be exposed in this manner if damage and/or unwanted wafer surface patterns are to be avoided. A more convenient and complete monitoring of the wafer is being sought.

SUMMARY OF THE INVENTION

It is an object of the present invention to provide in-situ monitoring of wafer surface characteristics during a polishing operation.

A related object of the present invention is to perform such monitoring on a real-time basis without requiring adaptation for changes in polishing parameters, such as slurry compositions, or polish wheel characteristics, for example.

Another object of the present invention is to provide in-situ direct observation of interior portions of the wafer surface, and not only the radially outer portions of the wafer surface.

These and other objects of the present invention which will become apparent from studying the appended description and drawings are provided in an arrangement for monitoring a surface of a semiconductor wafer, comprising:

a support table having an upper, support surface for engaging the surface of the semiconductor wafer to provide support for the semiconductor wafer;

an annular recess defined by the support table, extending to the support surface so as to form an opening therein;

a monitoring probe disposed in the recess and having a free end portion adjacent the semiconductor wafer to monitor the semiconductor wafer surface without interfering with the semiconductor wafer surface.

Other objects of the present invention are provided in an arrangement for polishing a surface of a semiconductor wafer, comprising:

a support table having a central axis and an upper, support surface for engaging the surface of the semiconductor wafer to provide support for the semiconductor wafer;

an annular recess defined by the support table, extending to the support surface so as to form an opening therein, between two annular support surface portions;

a polish pad covering the support surface of the support table;

a monitoring probe disposed in the recess and having a free end portion adjacent the semiconductor wafer to monitor the semiconductor wafer surface without interfering with the semiconductor wafer surface;

a support arm for pressing the semiconductor wafer surface against the polish pad; and table rotating means for rotating the support table about the central axis, with the monitoring probe supported against rotation with the table.

DETAILED DESCRIPTION OF THE PREFERRED EMBODIMENTS

Figure 1:
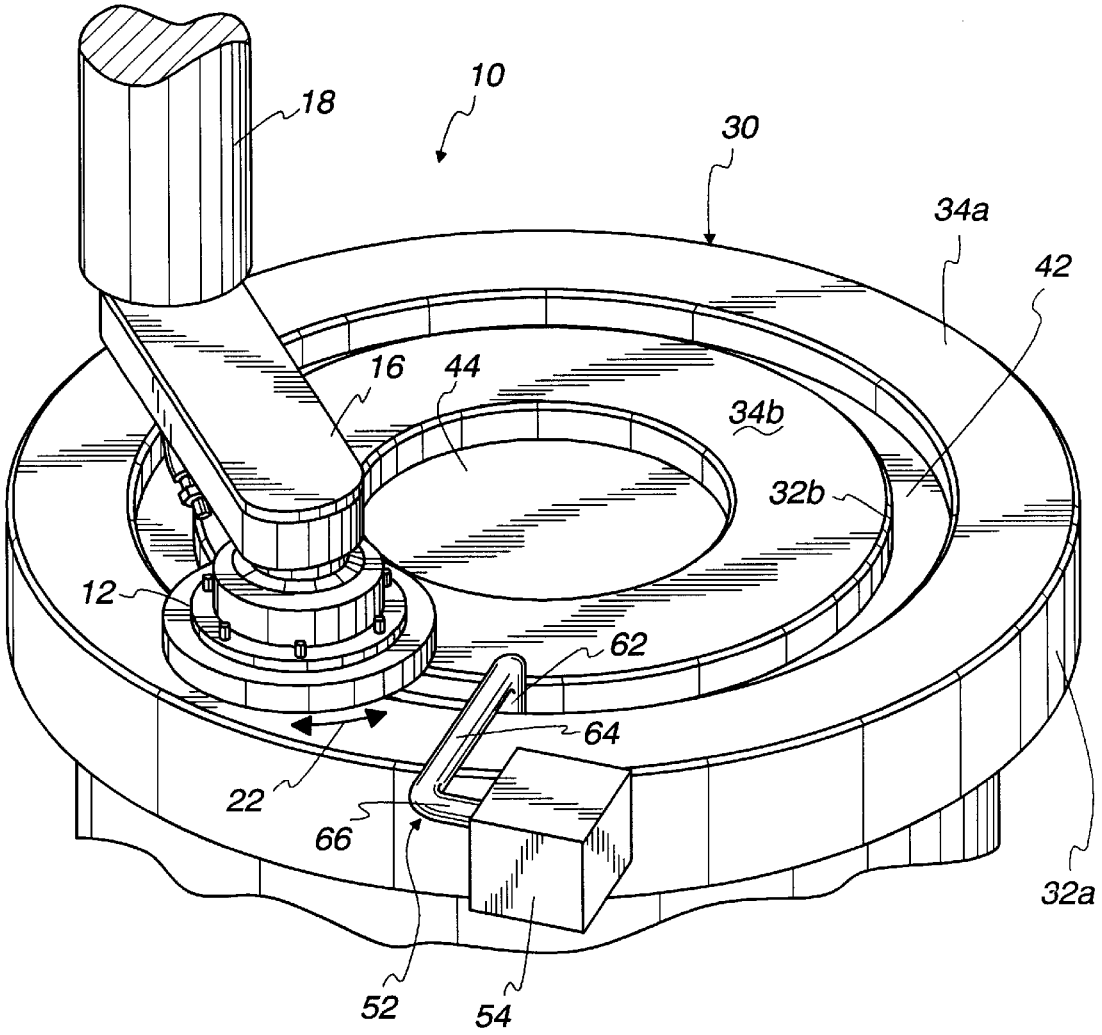
FIG. 1 is a fragmentary perspective view of an end point detection apparatus according to principles of the present invention.
Figure 2:
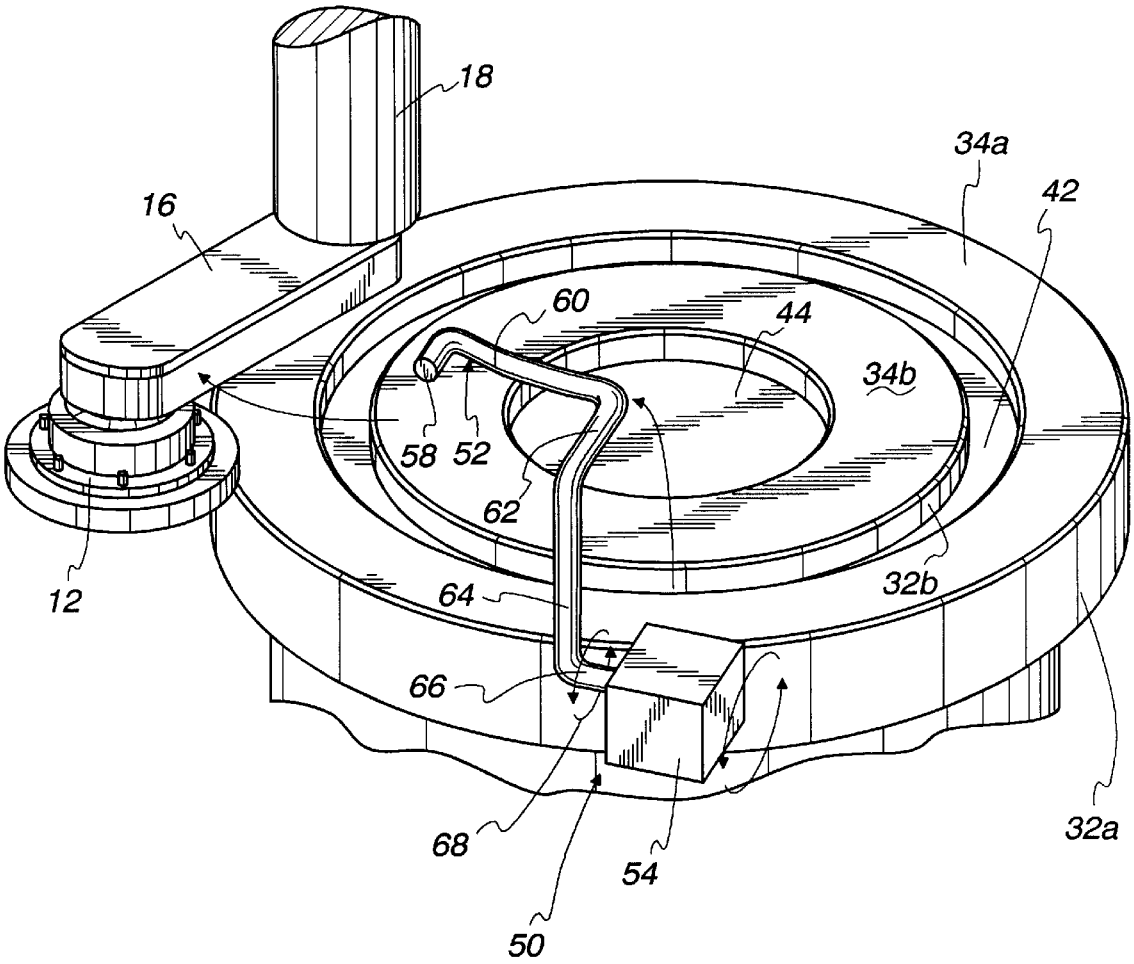
FIG. 2 is a fragmentary perspective view similar to that of FIG. 1, but showing the detection probe in a retracted position.
Figure 3:
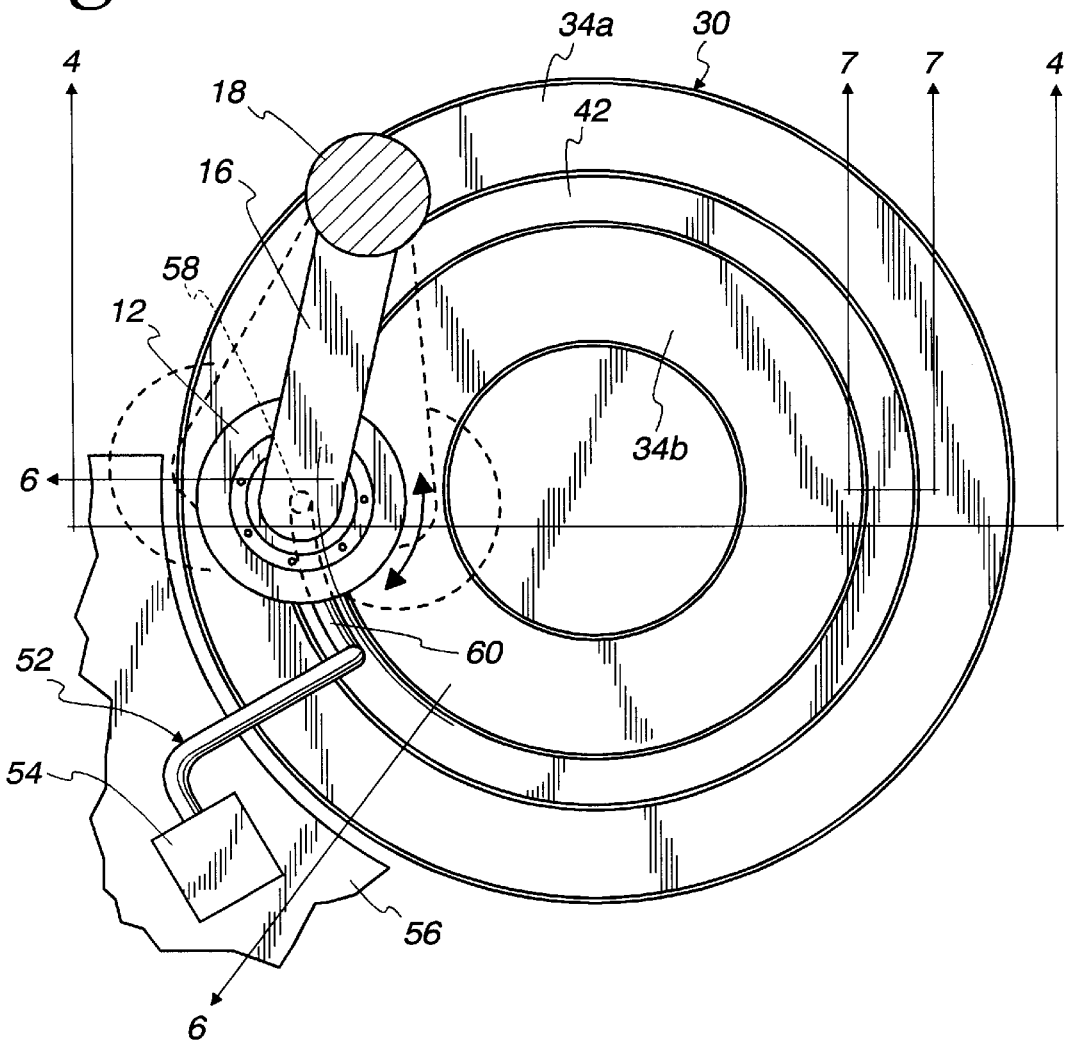
FIG. 3 is a top plan view of the arrangement of FIG. 1.

Referring now to the drawings, and initially FIGS. 1–5, wafer polish apparatus is generally indicated at 10. Included is a conventional wafer carrier or chuck 12 having a downwardly facing recess 14 for holding captive a semiconductor wafer 80 (see FIG. 5). Wafer carrier 12 is supported at one end of a reciprocating arm 16 which pivots about the central axis of a drive member 18. In a known manner, the support arm 16 reciprocates back and forth sweeping out an arcuate path, as indicated in FIG. 3. Extreme positions of the support arm 16 and wafer carrier 12 are shown exaggerated in FIG. 3 for purposes of illustration. It is generally preferred that the wafer carrier 12 be driven for rotation about its central axis so as to rotate in the direction of arrow 22 shown in FIG. 1.

In addition to imparting a reciprocating motion to the wafer carrier, support element 18 also applies a carefully controlled downward pressure on the wafer located within carrier 12. If desired, the support element 18 and arm 16 can be replaced by the arrangement shown in commonly assigned U.S. Pat. No. 5,329,732, the disclosure of which is incorporated by reference as if fully set forth herein. In U.S. Pat. No. 5,329,732 the wafer carrier 12 is supported from above by mechanism which imparts a reciprocating motion of the kind indicated in FIG. 3.

Referring again to FIGS. 1–5, a polish wheel assembly is generally indicated at 30. Polish wheel assembly 30 includes an underlying, supporting, polish wheel 32 having an upper, support surface 33 (see FIG. 7) to which a layer of suitable polish pad material 34 has been affixed by conventional means, such as pressure sensitive adhesive. According to one aspect of the present invention, the upper surface of polish table 32 is divided into two parts, 32*a* and 32*b*, by an annular groove 42. Preferably, polish table 32 has a hollow center 44 and, accordingly, recess 42 forms two nested, concentric, spaced-apart annular surface portions in the polish wheel. The outer annular surface portion of the polish wheel is covered with an annular polish pad section 34*a*, while the inner polish wheel portion 32*b* has its upper surface covered with an annular polish pad section 34*b*.

Figure 4:
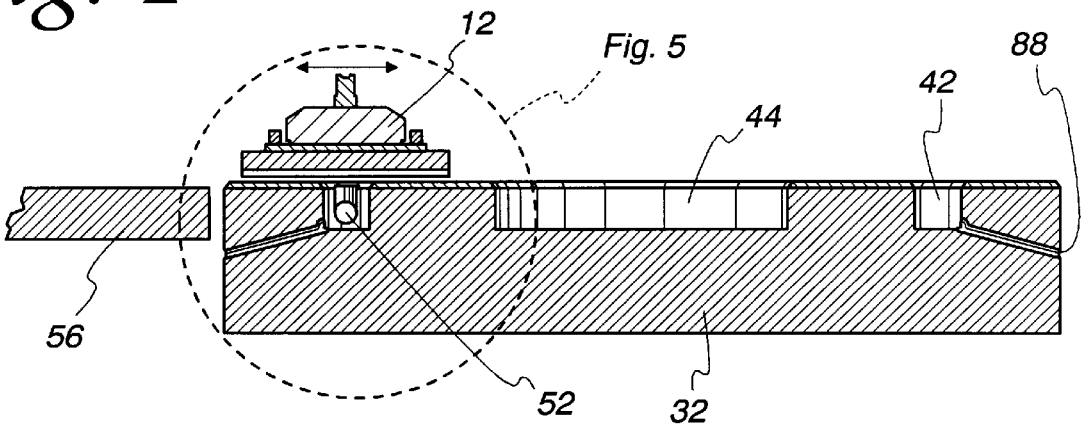
FIG. 4 is a fragmentary cross-sectional view taken along the line 4—4 of FIG. 3.
Figure 5:
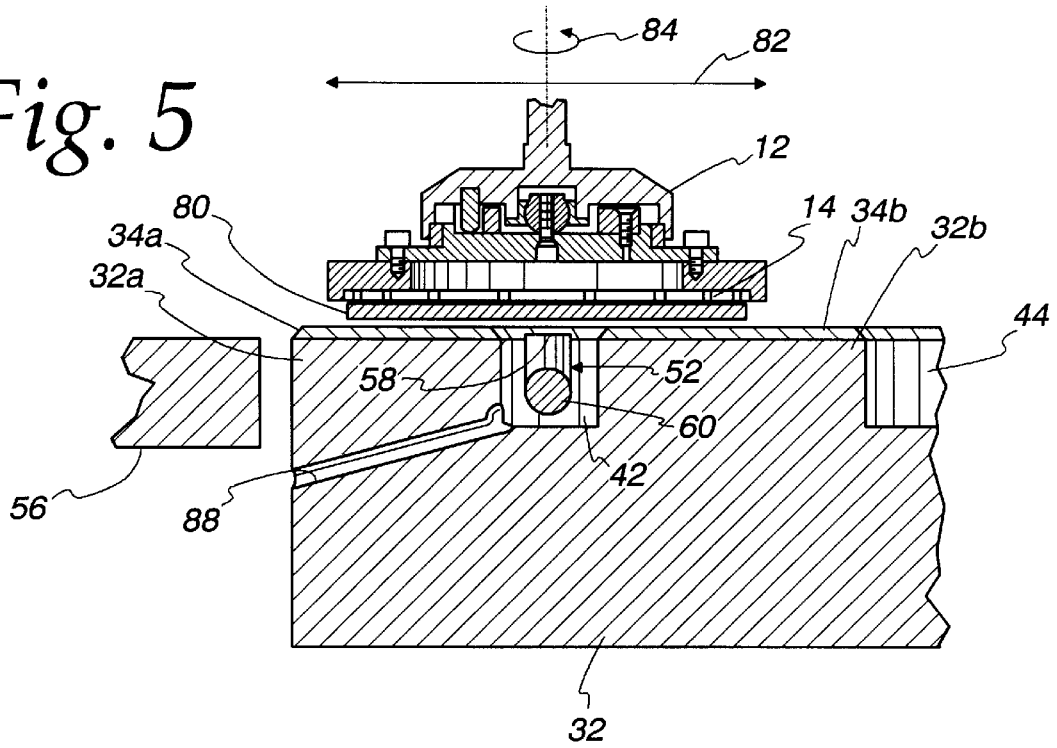
FIG. 5 shows an enlarged portion of FIG. 4.

Referring now to FIG. 2, a probe assembly is generally indicated at 50 and includes a probe 52 and a controller 54 mounted to one side of the polish wheel assembly. As can be seen in FIGS. 3–5, for example, controller 54 is mounted on a table 56 located adjacent the polish wheel. Probe 52 has a free end 58 which is upturned away from a generally arcuate portion 60. An upstanding portion 62 rises out of recess 42 as can be seen in FIG. 1, allowing the probe end 64 to extend above the surface of the polish wheel, as can be seen in FIG. 1. Probe 52 is supported in cantilever fashion from controller 54 and is mounted for rotation along the central axis of stub end portion 66, in the direction of the arrows 68, as shown in FIG. 2. Preferably, arcuate portion 60 of probe 52 is made slightly larger than the radius of carrier 12 so as to allow the upright portion to clear the polishing wheel. The probe 52 preferably is constructed so as to retain its desired shape in a self-supporting manner. The outer sheaf of the probe cable can, if desired, be made sufficiently rigid for this purpose. Alternatively, the probe and/or probe cable can be fitted within an outer supporting conduit.

Figure 6:
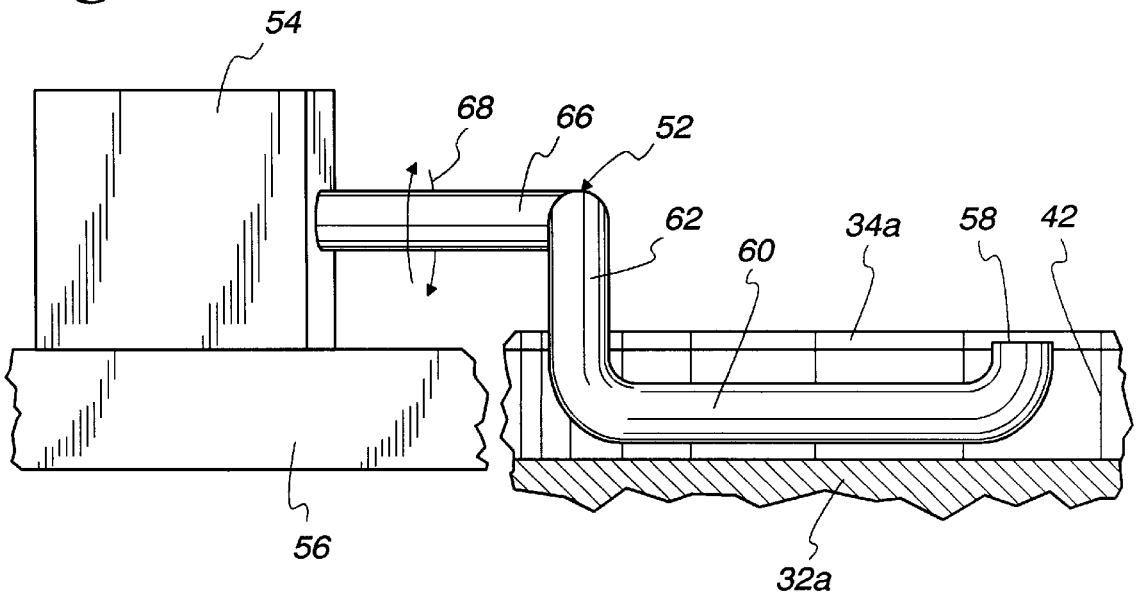
FIG. 6 is a fragmentary cross-sectional view taken along the line 6—6 of FIG. 3.

In FIG. 1, probe 52 is rotated in a downward direction such that the arcuate portion 60 and free end 58 are received within recess 42, as shown in FIG. 6. With probe 52 rotated in the opposite direction by controller 54, the probe is raised out of recess 42 so as to allow maintenance operations to be performed on the polish wheel.

Figure 10:
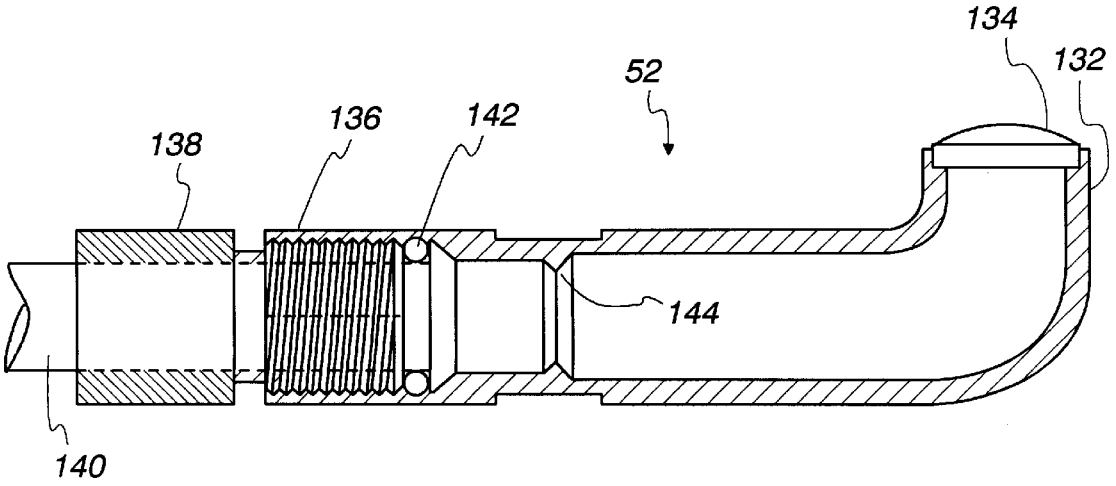
FIG. 10 is a cross-sectional view of a probe used with end point detection apparatus.

The internal construction within probe 52 is of conventional design. Referring to FIG. 10, the probe 52 includes a ferrule or lens housing 130, preferably formed of a 316 stainless steel and having a forward or open end 132 for receiving a conventional optical lens (such as Part No.

A31,854 (available from Edmund Scientific Company of Barrington, N.J.). Lens housing 130 includes a second end 134 which is threaded to receive a nut 138 used to secure a conventional optical cable 140. Preferably, the nut 138 includes external threads received within the threaded hollow end 136 of housing 130. The nut 138 is preferably sealed to housing 130 with a VITON o-ring 142. As an optional feature, housing 130 includes an internal annular restriction 144, preferably having a cross-sectional angle of approximately 90 degrees and having an internal free end terminating in a radius of 0.2 millimeter, so as to form an internal diameter of approximately 7 millimeters. The lens 134 is installed within housing 130 in a fluid-type arrangement, using a suitable feeling adhesive. The cable 140 has a free end prepared in a conventional manner, which is thereafter inserted within housing 130, preferably in a nitrogen-filled environment. Nut 138 and o-ring 132 are then applied to seal the nitrogen-filled interior of housing 130, to prevent undesirable fogging of lens 134. In the preferred embodiment, the free end 58 of probe 52 has optical monitoring capability for direct observation of a wafer being polished. If desired, the probe may include a conventional air jet means (not shown) for keeping the face of free end 58 clean and free of slurry so as to allow continuous, uninterrupted monitoring.

As indicated in FIG. 3, the free end 58 of probe 52 is located adjacent the exposed surface of a wafer held in carrier 12. As the carrier is reciprocated back and forth, and rotated about the central axis of carrier 12, the probe 52 is made to observe the entire surface of the semiconductor wafer, on an ongoing real-time basis, without interfering with the polishing operation.

Figure 7:
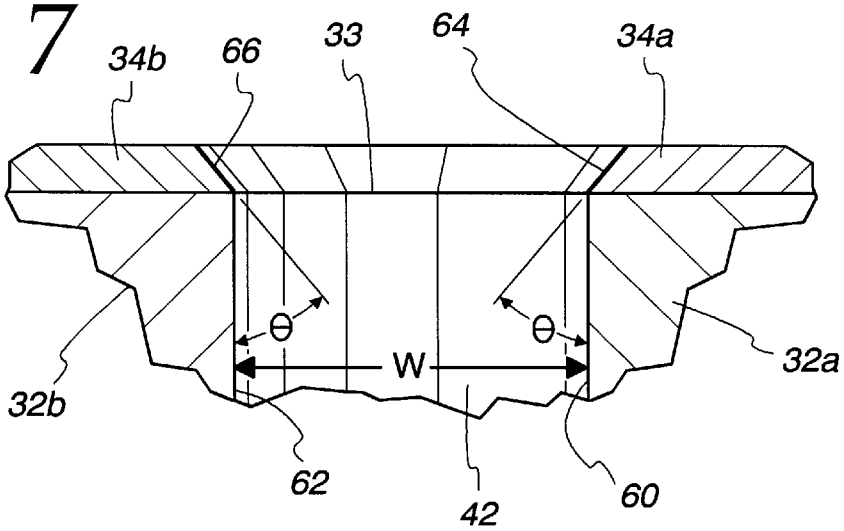
FIG. 7 is a fragmentary cross-sectional view, on an enlarged scale, taken along the line 7—7 of FIG. 3.

Referring to FIG. 7, as mentioned above, the upper surface of annular polish wheel portions 32*a*, 32*b* are covered with respective annular portions 34*a*, 34*b* of polish pad material. In the preferred embodiment, as mentioned, the polish pad material is secured to the polish wheel with a suitable contact adhesive. Preferably, installation of the polish pad material is accomplished by covering both inner and outer annular portions of the polish wheel with a single, unitary polish pad. Initially, the polish pad material spans the recess 42, and is trimmed away from the recess by a knife blade or other cutting instrument.

Referring again to FIG. 7, annular polish wheel portions 32*a*, 32*b* have opposed vertical faces 60, 62. The relative dimensions of recess 42 are shown exaggerated in the drawings, for clarity of illustration. It is preferred that the lateral width W of recess 42 range between 2% and 6% of the outer radius of the polish wheel. Most preferably, the lateral width W of recess 42 ranges between 2% and 4% of the polish wheel radius.

If desired, the polish pad material could be trimmed substantially parallel to the wall faces 60, 62. However, in operation, the polish pad material is compressed by pressure applied to carrier 12, pressing the semiconductor wafer against the polish pad material. Depending on the type of polish pad material and the amount of pressure applied, it is possible that the polish pad material would "grow", extending beyond wall faces 60, 62. In certain types of polishing operations, this may result in unwanted surface pattern formations. Accordingly, it is preferred that the cuts on annular polish pad portions 34*a*, 34*b* be made upwardly diverging by an angular relief, θ ranging between 0° and 60°. Most preferably, the angle of relief, θ, ranges between 10° and 45°. By employing the angular relief mentioned above, a beveled edge is imparted to the opposed edges 64, 66 of annular polish pad portions 34*a*, 34*b*. As can be seen in FIG. 5, it is generally preferred that the radially inner edge of polish pad portion 34*b* and the radially outer edge portion of polish pad portion 34*a* also be beveled to prevent unwanted surface formations on a polished surface of the semiconductor wafer.

Referring again to FIG. 5, semiconductor wafer 80 is shown positioned slightly above the upper surface of the polish pad and slightly below carrier recess 14, for clarity of illustration. In operation, the semiconductor wafer 80 is held captive in recess 14 and is pressed against the polish pad material. In certain instances, the polish pad material may be caused to undergo a certain amount of compression. As can be seen in FIG. 5, this results in the underneath surface of semiconductor wafer 80 being closely spaced with respect to the free end 58 of probe 52. As the wafer carrier is oscillated back and forth in the direction of arrow 82 and is spun about the central axis of wafer carrier 12 (as indicted by arrow 84), portions of the wafer surface travel alternately across the polish pad material and the free end 58 of probe 52, with the underneath surface of semiconductor wafer 80 being monitored continuously on a real-time basis. As will be appreciated, virtually the entire surface of the semiconductor wafer is directly observed with the arrangement of the present invention.

Although, in the preferred embodiment, probe 52 operates on an optical basis, the probe could also operate beyond the frequencies of visible light. In addition, two adjacent probes could be employed, one for transmission and one for reception, for example, if desired. The probes could, for example, resemble the probe 52 shown in FIG. 10, except that the 90 degree bend could be replaced by a smaller angled bend, e.g. 45 degrees. In this manner, a pair of oppositely directed mirror-image probes could be mounted for simultaneous operation within channel 42.

As mentioned above, it is preferred that a slurry or some form of fluid material be present between the upper surface of the polish pad material and the bottom surface of semiconductor wafer 80. As the semiconductor wafer 80 passes over the probe 52, it is possible that slurry may become deposited on the probe free end 58. As mentioned above, the probe of the preferred embodiment includes cleaning means which passes a jet of air over the face of the probe, keeping the probe face clean. Also, substantial quantities of slurry may accumulate in recess 32. Accordingly, as shown in FIG. 5, a vent passageway 88 is formed in polish wheel 32 to direct slurry out of recess 42. If desired, a vacuum may be applied adjacent the bottom floor of recess 42 to draw slurry material away. For example, a passageway may be formed between recess 42 and the central portion 44 of polish wheel 32 for convenient conventional coupling to a vacuum source.

As mentioned, it is generally preferred that the radially inner and outer annular portions of the polishing wheel be covered with a single unitary polishing pad which is thereafter divided by cutting in accordance with the above description. Accordingly, it is desired that the probe be removed from recess 42 to facilitate replacement of the polishing pad. As mentioned above, probe 52 is preferably mounted for rotation by controller 54. However, other types of mounting arrangements are also possible. For example, probe 52 could be mounted with the same type of mechanism as a conventional phonograph tone arm in which the free end of the probe is first raised above recess 42 and then swung in a horizontal direction over the top of the polishing wheel. Further, the rotational drive of the controller 54 could be mounted on a conventional elevator or lifting mechanism to raise the probe out of recess 42, before rotation is initiated. Using any of the above arrangements, the probe is rotated out of recess 42 in preparation for the polishing pad replacement. One advantage of the above described arrangements is that the probe remains connected to control circuitry throughout various phases of operation of the polishing wheel.

Figure 8:
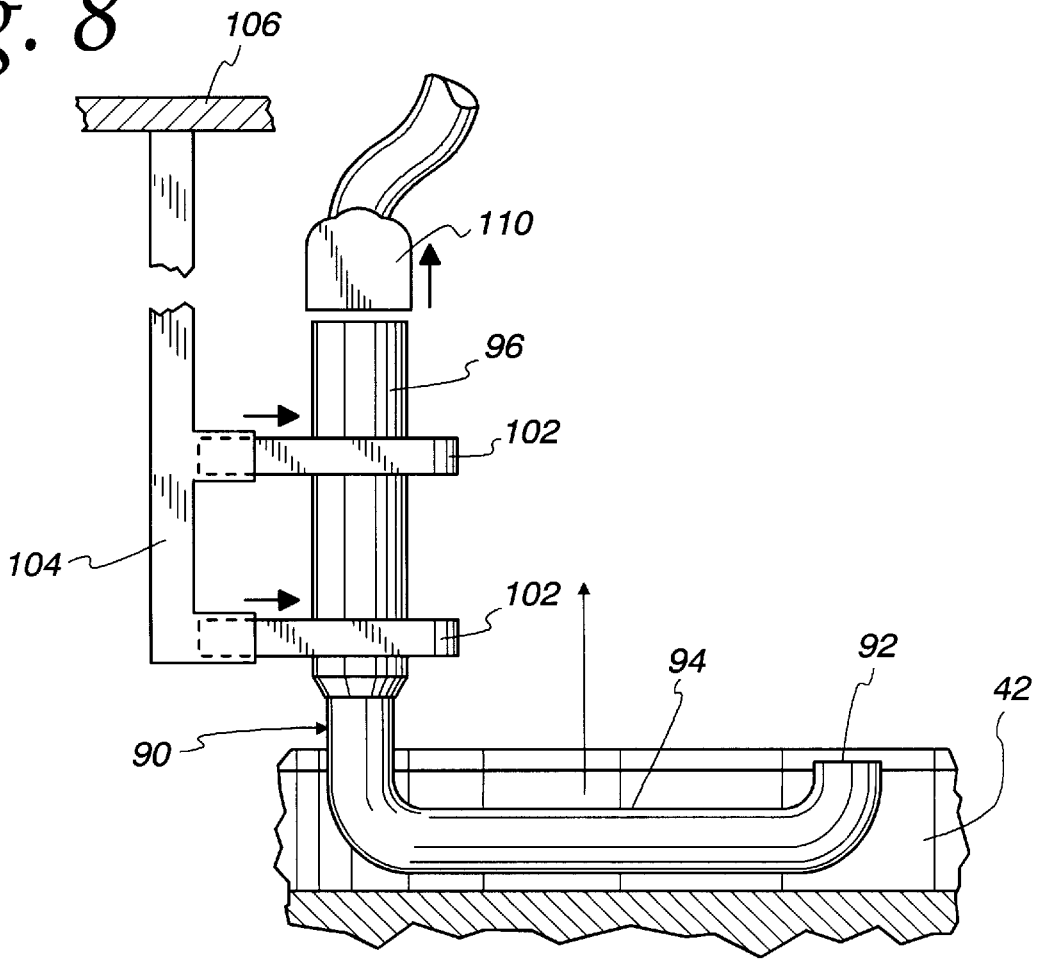
FIG. 8 is a fragmentary cross-sectional view similar to that of FIG. 6, but showing an alternative detection probe arrangement.

Referring now to FIG. 8, an alternative arrangement is shown with a probe 90 having a free end 92 for direct observation of the semiconductor wafer being polished. Free end 42 is carried at one end of a relatively short arcuate portion 94, generally resembling the arcuate portion 60 shown above. Probe 90 includes a second free end 96 comprising a plug portion for slip fit connection to a socket member 110. Probe 90 is mounted on a pair of arms 102, which are removably connected to a hanger 104 suspended from an overlying support member 106. The support member 106 extends upwardly from the table 56 or is otherwise supported from the floor on which the polishing machine is positioned. When service of the polishing wheel is required, separable connector 110 is removed from the free end of probe 96 and arms 102 are removed from hanger 104, allowing the probe 90 to be lifted out of recess 42.

Figure 9:
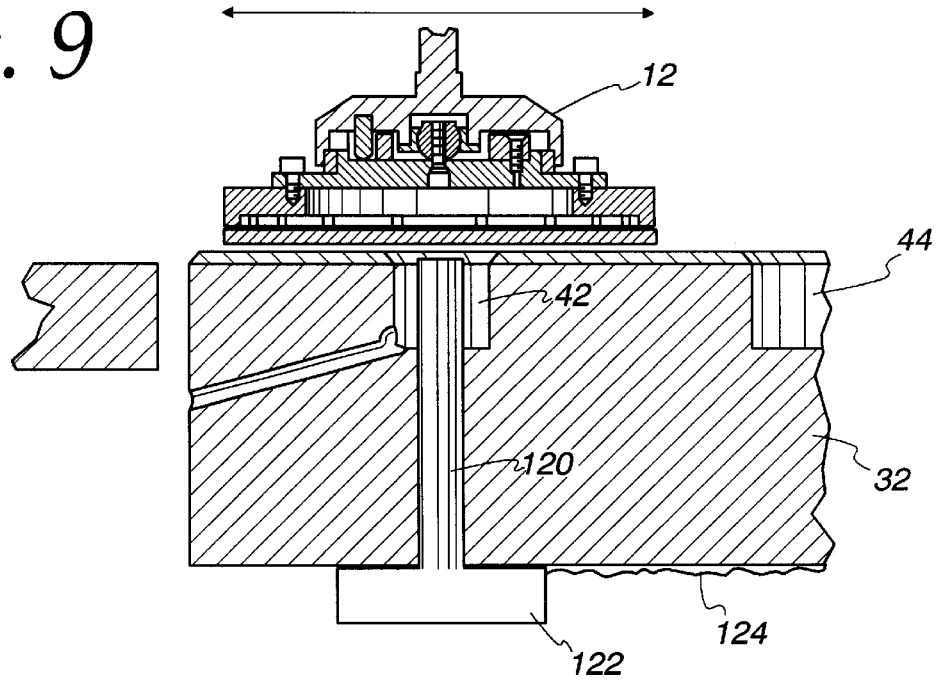
FIG. 9 is a cross-sectional view similar to that of FIG. 5, but showing alternative connection for the detection probe.

Referring now to FIG. 9, an alternative arrangement is shown with probe 120 mounted in polish wheel 132 and having an upper free end positioned within recess 42. The lower end of probe 120 is received within a communications module 122 which converts the probe data into a form which can be carried along conductors 124, which in turn are terminated with a conventional rotational coupling (not shown) adjacent the center of polish wheel 32. If desired, the communications module could take the form of a radio transmitter, so as to eliminate the need for electrical connectors 124 and an associated rotational coupling.

Thus, it can be seen that arrangements are provided for the continuous monitoring of a wafer surface during polishing or other surface operation. Existing commercial probe components can be readily employed with the present invention, with a minimum of modification. The probe arrangement of the present invention has found immediate use in end point determination for polishing operations. However, continuous monitoring of wafer surfaces according to principles of the present invention can also be employed for other purposes, such as the surfacing of computer data storage hard disk substrates, coated hard disks and magnetic read/write heads.

If desired, other conventional constructions of optical probes and probes operating in regimes other than those which are optically sensible may be used.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. An arrangement for polishing a surface of a semiconductor wafer, comprising:

a support table having a central axis and an upper, support surface for engaging the surface of the semiconductor wafer to provide support for the semiconductor wafer;

an annular recess defined by the support table, extending to the support surface so as to form an opening therein, between two annular support surface portions;

a polish pad covering the support surface of the support table;

a monitoring probe disposed in the recess and having a free end portion adjacent the semiconductor wafer to monitor the semiconductor wafer surface without interfering with the semiconductor wafer surface a support arm for pressing the semiconductor wafer surface against the polish pad; and table rotating means for rotating the support table about the central axis, with the monitoring probe supported against rotation with the table.

2. The arrangement of claim 1 wherein the probe free end portion comprises an arcuate portion with an upturned free end.

3. The arrangement of claim 1 further comprising mounting means for mounting the probe for movement into and out of said recess.

4. The arrangement of claim 1 wherein said mounting means includes rotational mounting means for mounting the probe for rotational movement into and out of said recess.

5. The arrangement of claim 1 wherein said polish pad comprises a single unitary polish pad covering substantially the entire support surface, the single unitary polish pad being divided into two portions to expose the recess.

6. The arrangement of claim 5 wherein said support surface is divided into two annular support surface portions by said recess, with said polish pad being divided into two spaced apart annular polish pad portions having opposing beveled edges adjacent said recess.

7. The arrangement of claim 1 wherein said support arm moves the semiconductor wafer back and forth across said annular recess to move the semiconductor wafer surface across said monitoring probe.

8. An arrangement for monitoring a surface of a semiconductor wafer, comprising:

a support table having an upper, support surface for engaging the surface of the semiconductor wafer to provide support for the semiconductor wafer;

an annular recess defined by the support table, extending to the support surface so as to form an opening therein; and a monitoring probe disposed in the recess and having a free end portion adjacent the semiconductor wafer to monitor the semiconductor wafer surface without interfering with the semiconductor wafer surface.

9. The arrangement of claim 8 wherein the probe free end portion comprises an arcuate portion with an upturned free end.

10. The arrangement of claim 8 further comprising mounting means for mounting the probe for movement into and out of said recess.

11. The arrangement of claim 8 wherein said mounting means includes rotational mounting means for mounting the probe for rotational movement into and out of said recess.

12. The arrangement of claim 8 further comprising a polish pad covering the support surface of the support table.

13. The arrangement of claim 12 wherein said polish pad comprises a single unitary polish pad covering substantially the entire support surface, the single unitary polish pad being divided into two portions to expose the recess.

14. The arrangement of claim 13 wherein said support surface is divided into two annular support surface portions by said recess, with said polish pad being divided into two spaced apart annular polish pad portions having opposing beveled edges adjacent said recess.

15. The arrangement of claim 12 further comprising a support arm for supporting the semiconductor wafer, for pressing the semiconductor wafer surface against the polish pad, and for moving the semiconductor wafer across said annular recess to move the semiconductor wafer surface across said monitoring probe.

16. The arrangement of claim 12 wherein the support table has a central axis, the arrangement further comprising table rotating means for rotating the support table about the central axis, with the monitoring probe supported against rotation with the table.

17. An arrangement for treating the surface of a semiconductor wafer, comprising:

a support table having an upper, support surface for engaging the surface of the semiconductor wafer;

rotatable mounting means for mounting the table for rotation;

an annular recess defined by the support table, extending to the support surface so as to form an opening therein;

a monitoring probe disposed in the recess and having a free end portion adjacent the semiconductor wafer to monitor the semiconductor wafer surface without interfering with the semiconductor wafer surface; and stationary mounting means for stationary mounting of said monitoring probe within said recess.

18. The arrangement of claim 17 wherein said stationary mounting means includes means for inserting and withdrawing said monitoring probe with respect to said recess.

* * * * *